United States Patent [19]

Mancel

[11] Patent Number: 4,679,529

[45] Date of Patent: Jul. 14, 1987

[54] STEAM GENERATOR FEED WATER HEATER

[75] Inventor: Gérard Mancel, Houilles, France

[73] Assignee: Electricite de France Service National, Paris, France

[21] Appl. No.: 853,951

[22] Filed: Apr. 21, 1986

[30] Foreign Application Priority Data

Apr. 24, 1985 [FR] France ..... 85 06219

[51] Int. Cl.[4] ..... F22D 1/30; F22D 1/34

[52] U.S. Cl. ..... 122/441; 55/185; 55/462; 122/414; 122/489; 165/110; 165/159; 165/174; 239/553.3; 239/590.3

[58] Field of Search ..... 122/34, 412, 414, 415, 122/441, 457, 458, 459, 483, 488, 489; 165/110, 111, 159, 174; 55/183, 185–188, 462, 463; 239/553.3, 559, 590.3

[56] References Cited

U.S. PATENT DOCUMENTS

| | | | |
|---|---|---|---|
| 1,987,962 | 1/1935 | Leupold | 239/590.3 |
| 3,381,746 | 5/1968 | Wiegmann et al. | 165/111 |
| 3,795,273 | 3/1974 | Brigida et al. | 122/410 X |
| 3,941,314 | 3/1976 | Moss et al. | 239/553.3 |

FOREIGN PATENT DOCUMENTS

| | | |
|---|---|---|
| 0076333 | 4/1983 | European Pat. Off. . |
| 2402774 | 7/1975 | Fed. Rep. of Germany . |
| 1341291 | 9/1963 | France . |
| 2188127 | 1/1974 | France . |
| 1215187 | 12/1970 | United Kingdom . |

*Primary Examiner*—Albert J. Makay
*Assistant Examiner*—Steven E. Warner
*Attorney, Agent, or Firm*—Charles E. Brown; Charles A. Brown

[57] ABSTRACT

A steam generator feed water heater comprises a pressurized enclosure inside which is a heat exchanger through which the feed water is caused to flow. There is at least one horizontal condensate inlet tube, as well as at least one condensate outlet tube at a low point on the enclosure. A double screen device associated with the condensate inlet tube comprises an inner screen with a cylindrical side wall and, surrounding this inner screen, an outer screen having one end linked to the inner screen. A bottom wall common to both screens constitutes an impact wall facing the inner screen. Passage areas are provided by perforations in the screens not facing each other over most of the perimeter of their transverse cross-sections.

7 Claims, 6 Drawing Figures

STEAM GENERATOR FEED WATER HEATER

BACKGROUND OF THE INVENTION

1. Field of the Invention

The present invention concerns steam generator feed water heaters, especially for power stations in which the steam produced drives one or more turbines.

2. Description of the Prior Art

For improved energy efficiency the steam generator feed water is pre-heated in a heat exchanger or heater using as heating fluid bleed steam and condensates recovered from the outlets of various units of the system such as driers and condensors.

Using condensates to feed the heaters is favorable to the overall energy balance of the installation; the usable heat recovered in this way can represent a significant fraction (15 to 25%) of the heat employed.

As a general rule, a heater has an elongate pressurized enclosure comprising in the vicinity of one end at least one condensate inlet tube. Experience shows that because of the turbulence of the incoming flow, which generally expands inside the heater, the parts adjacent the inside wall are exposed to violent erosion leading to a relatively rapid reduction in their thickness.

To overcome this problem it has been proposed to provide within the enclosure, facing the condensate inlet tube, an impact wall intended to dissipate some of the kinetic energy of the jet of condensate issuing from this tube. In practice, however, the speed of the flow of condensate at the walls remains high and the erosion phenomena remain.

In another prior art solution the walls of the enclosure are made from a steel that resists erosion. This solution entails high manufacturing costs, however, the alloy employed being costly and difficult to use.

An object of the invention is to alleviate these disadvantages by means of a specific arrangement of the way in which condensates are admitted to the heated enclosure.

SUMMARY OF THE INVENTION

The present invention consists in a steam generator feed water heater comprising a pressurized enclosure, a heat exchanger through which the feed water is caused to flow, at least one horizontal condensate inlet tube, at least one condensate outlet tube at a low point on said enclosure, and a double screen device associated with said at least one condensate inlet tube and comprising an inner screen with a cylindrical side wall and, surrounding said inner screen, an outer screen having one end linked to said inner screen, a bottom wall common to both screens constituting an impact wall facing said inner screen, and passage areas in which there are provided perforations in said screens not facing each other over most of the perimeter of their transverse cross-sections.

Thus outwardly radially out flow from passage area of the first screen is deviated axially to escape through passage area of the second screen.

This arrangement makes possible good separation of the two-phase water/steam mixture that the condensates comprise; the upward escape of the steam and the downward flow of the liquid phase are advantageously favored, the consequence of which is to reduce the volume flowrate of the condensates and therefore the speed thereof along the inside walls of the enclosure. The chicane arrangement of the passage areas also contributes to dissipating the kinetic energy of the incoming flow of condensates. It provides a substantial improvement in flow conditions along the walls and procures a distribution of speeds compatible with the nature of the materials constituting these walls, so reducing the risk of erosion and corrosion.

In one preferred embodiment of the invention the sleeve constituting the inner screen comprises a median passage area delimited in the axial direction whereas the jacket forming the outer screen comprises a barrel which is perforated over its entire surface but has its median part covered with a mask or deflector with no perforations, extending over a circular arc subtending an angle at the center of the transverse cross-section in excess of 180°.

This design makes it possible to experiment with masks with different shapes to determine optimum conditions according to the specific circumstances of each type of installation.

The characteristics and advantages of the invention will emerge from the following description given by way of example with reference to the accompanying diagrammatic drawings.

DESCRIPTION OF THE PREFERRED EMBODIMENT

Figure 1:
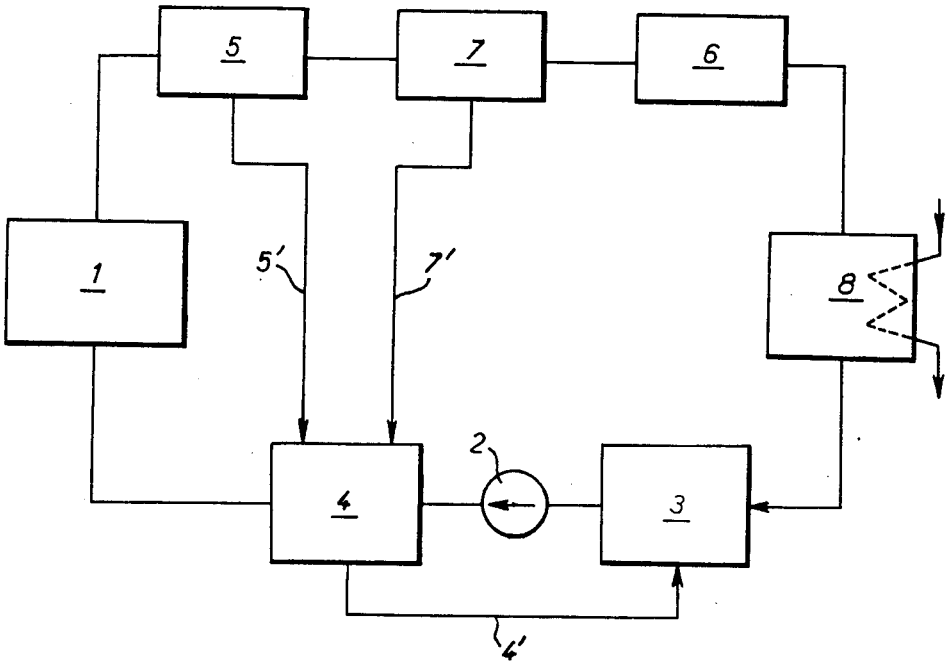
FIG. 1 is a simplified schematic representation of a turbine steam feed circuit.

In the extremely simplified schematic of figure 1, a turbine steam feed circuit comprises a steam generator 1 supplied by a pump 2 with water from a water tank or feed tank 3 after passing through an economizer or heater 4. From the output of the generator 1 the steam is passed through a high-pressure turbine 5; the steam exhausting from the high-pressure turbine 5 feeds a low-pressure turbine 6 after processing in a dryer 7; a certain amount of steam bled from the high-pressure turbine 5 is directed at 5' to the heater 4, however. Also, a condensates outlet from the dryer 7 is connected at 7' to an inlet of the heater 4 an outlet 4' of which is connected to the feed tank 3.

The steam exhausting from the low-pressure turbine 6 is condensed in a condensor 8 the outlet from which is connected to the feed tank 3.

In the heater 4 the steam bled from the high-pressure turbine 5 and the condensates issuing from the dryer 7 give up part of their available heat to the feed water for the steam generator 1.

A heater of this kind makes it possible to improve the overall energy efficiency of the system.

In practice, the installation might comprise a number of bleed points and a number of dryers.

Figure 2:
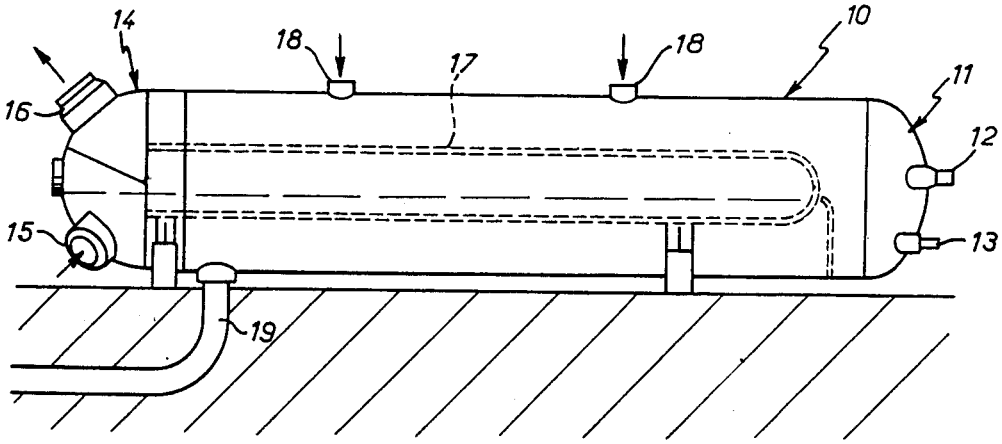
FIG. 2 is a view in elevation of a steam generator feed water heater.

In FIG. 2, the heater 4 comprises a closed cylindrical enclosure 10 disposed horizontally. One end 11 of this enclosure 10 forms an eliptical base with a condensate inlet tube 12 discharging in the vicinity of the center of the base 11 and a second condensate inlet tube 13 disposed at a lower level.

The other end 14 of the enclosure 10 has a feed water inlet 15 and a feed water outlet 16 connected to a diaper-pin shaped bundle of tubes 17 carrying the feed water to be heated.

On the upper part of the body of the enclosure are two bleed steam inlets 18 and in the lower part a condensate outlet conduit 19.

There is a condensate inlet area in the vicinity of the end 11, delimited in the axial direction by an overflow on the downstream side of which there is retained a body of water of appropriate depth, in particular to prevent any escape of steam through the condensate outlet 19.

Figure 3:
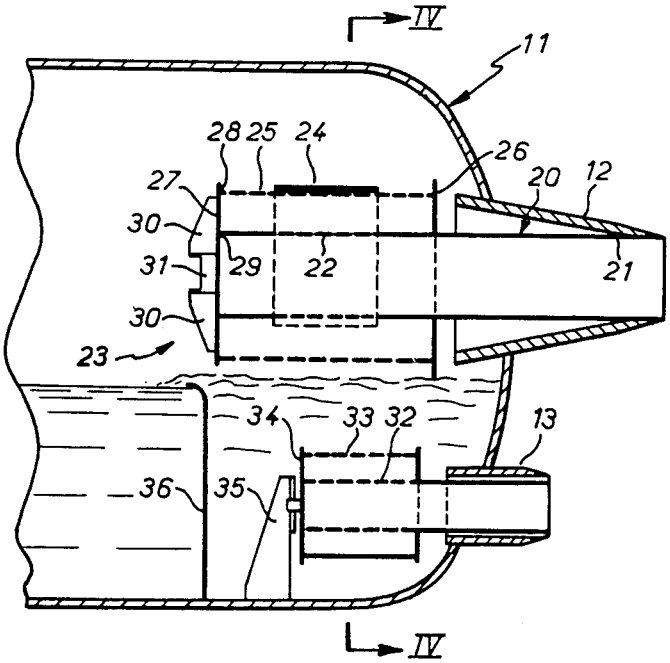
FIGS. 3 and 4 are respectively longitudinal and transverse cross-sections of the device in accordance with the invention.
Figure 4:
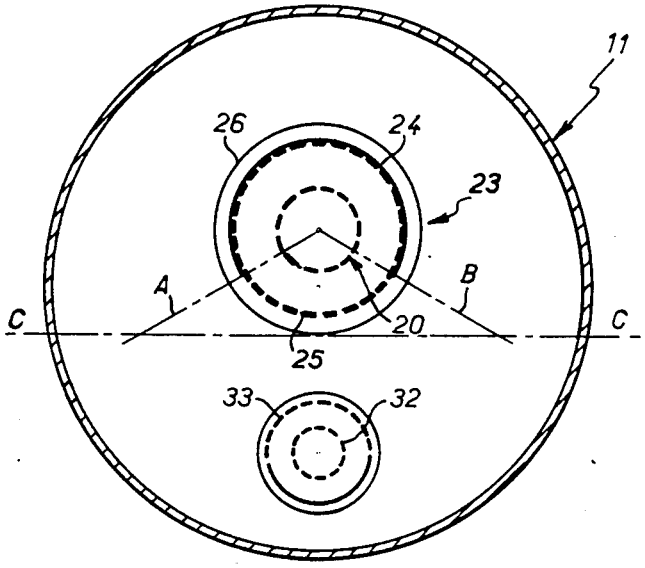

In the embodiment shown in FIGS. 3 and 4, the invention is applied to a heater comprising two condensate inlet tubes, a so-called main tube 12 disposed at a slightly raised level relative to the horizontal axis of the enclosure and a so-called secondary tube 13 disposed at a lower level. The invention essentially consists in the association with each of these tubes of a double screen device intended to optimize the condensate flow conditions.

Thus there are associated with the main tube 12:

- a sleeve 20 having a cylindrical-shape lateral wall connected at one end 21 to the tube 12 and featuring inside the enclosure 10 perforations in a median passage area 22 which is delimited in the axial direction; and
- a jacket 23 the lateral wall 25 of which is cylindrical in shape and of larger diameter than that of the sleeve 20 and which is disposed concentrically with the latter, one of its ends 26 being joined to the sleeve 20; this lateral wall or barrel 25 is of sheet metal perforated over its entire surface and partially covered by a sheet metal mask 24 without perforations, of rectangular shape and curved so as to extend over a circular arc subtending an angle of 180° or more in transverse cross-section.

In the axial direction this mask 24 extends over a length less than the length of the barrel 25 and equal to or greater than the length of the perforated median part 22 of the sleeve 20.

An impact wall 27 formed by a flat plate perpendicular to the axis of the condensate inlet tube forms a bottom common to the sleeve 20 and to the jacket 23 at their other ends 28 and 29.

In the known manner this structure is held in place by means of fixing flanges 30 between which there is disposed a bar 31 attached to the walls of the enclosure 10.

An analogous double screen device comprising a sleeve 32, a jacket 33 and an impact plate 34 is associated with the second condensate inlet tube 13 from a purge outlet of a so-called high-speed type dryer, for example, the jacket 33 having only its upper part perforated whereas the sleeve is perforated over all of its length within the jacket.

This structure is held in place by means of a fixing member 35 on the upstream side of the overflow 36.

In operation, in known manner, the feed water circulating in the diaper-pin shaped bundle of tubes 17 is heated by means of the bled-off steam, which is cooled and condenses on the walls of the tubes 17, and the condensates from the inlet tubes 12 and 13 which enter the enclosure 10 at high-speed, generally expanding so that they are partially vaporized.

The disposition of the mask 24 on the barrel 25, facing the perforated median area 22 of the sleeve, imposes on the incoming flow, which strikes the impact wall 27 to flow upwardly and sideways, a chicane-shaped path which favors separation of the steam, which tends to rise, from the water, which tends to fall under its own weight; the arrangement also dissipates part of the kinetic energy of the incoming flow of condensates.

In FIG. 4, A and B indicate the radial planes delimiting the peripheral area of the outer screen 23 which is covered by the mask 24 over two thirds, for example, of the circumference facing the passage area 22 of the inner screen. As a result, the part of the liquid phase of the incoming condensates that might tend to escape directly from the inner screen is confined within a solid angle delimited by the two planes A and B; this part of the liquid phase will therefore necessarily encounter, before it can reach the wall of the enclosure, the liquid mass already formed therein with an average level such as C-C determined by the overflow 36. The remaining part of the liquid phase escaping through the remainder of the passage area in the outer screen will necessarily have been subjected to at least one change in direction in the axial sense and thus a significant reduction in its kinetic energy. This explains the considerable reduction in erosion and corrosion of the walls of the enclosure that result.

The device associated with the secondary tube 13 may be simplified because the flowrate of condensates arriving via this inlet is normally lower and because this device is normally submerged in the mass of liquid accumulated on the upstream side of the overflow 36. Thus the passage area of the outer screen is deliberately limited to its upper half: this avoids any direct escape of the liquid phase in the direction of the immediately adjacent area of the wall of the enclosure which is located below the device.

Hydrodynamic studies carried out with inlet devices constructed in this way have shown that there results in the vicinity of the walls a distribution of speeds favoring long service life with walls made of ordinary quality steel.

Figure 5:
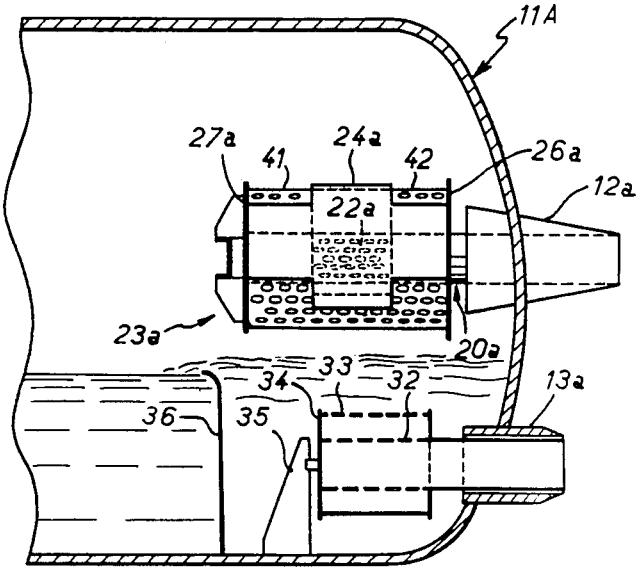
FIGS. 5 and 6 are respectively a view in longitudinal cross-section on the line V—V in FIG. 6 and a view in transverse cross-section of another embodiment of the invention.
Figure 6:
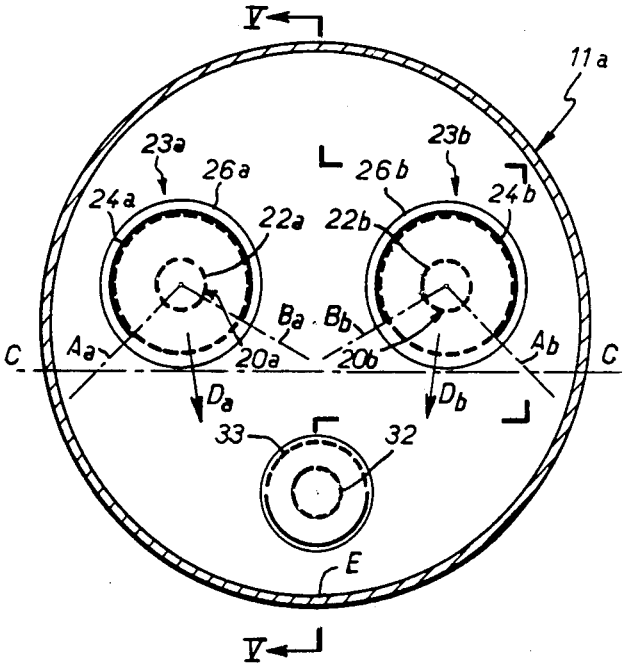

The embodiment shown in FIGS. 5 and 6 differs from the preceding one by the juxtaposed disposition to either side of a vertical diametral plane of the enclosure of two inlet tubes between which the main flow of incoming condensate is substantially equally divided. Also, there is used in this instance a different geometry of the mask covering the outer screen of the device associated with each of these two tubes.

The various component parts of the two devices are designated using the same reference numbers already used in the description of the embodiment of FIGS. 3 and 4, with the respective suffixes a and b.

Around the axially delimited passage area 22 in the median area of the inner screen **20*a* and outer screen 20*b* there are on the outer screens the mask 24*a*, 24*b* again extending over approximately two thirds of the circumference; in this instance, however, as can be seen in FIG. 5, the mask has on the side adjacent the wall a stop area with no perforations extending to either side of this median area, as far as the ends of the outer screen, this stop area subtending an angle of approximately 90° so as to protect the adjacent wall of the enclosure 10 whilst retaining upwardly and on the side opposite the lateral wall two passages areas 41, 42 facing non-perforated parts of the inner screen 20*a* (or 20*b***).

On the lower side (FIG. 6), the downward passage areas are offset angularly towards the center of the device; thus the planes Aa and Ba, for example, delimiting the downward passage of the outer screen 23*a* are offset a certain angle counterclockwise whereas the planes Ab and Bb of the other device are offset in the opposite direction. Consequently, the average directions in which the flows of condensate exit downwardly, as indicated by the arrows Da and Db, are oriented towards the lowest central part E which is therefore farthest from the wall of the enclosure.

The laterally adjacent parts of the wall of the enclosure are thus protected from direct impact of the flow of condensate escaping from the two devices.

The invention is not limited to the detailed embodiments which have been described by way of example, of course. Specifically, instead of comprising a barrel perforated over its entire surface and equipped with a mask, the outer screen could equally well consist of a barrel perforated only in predetermined passage areas. Also, an installation might comprise a number of heaters, possible connected in series; a heater of the type shown in FIGS. 5 and 6 could be disposed at the outlet from a heater of the type shown in FIGS. 3 and 4, for example, to receive the condensate issuing from the latter.

There is claimed:

1. Steam generator feed water heater comprising a pressurized enclosure, a heat exchanger through which the feed water is caused to flow, at least one horizontal condensate inlet tube, at least one condensate outlet tube at a low point on said enclosure, and a double screen device associated with said at least one condensate inlet tube and comprising an inner screen with a cylindrical sidewall and, surrounding said inner screen an outer screen having one end linked to said inner screen, a bottom wall common to both screens constituting an impact wall facing said inner screen, and passage areas in which there are provided perforations in said screens not facing each other over most of the perimeter of their transverse cross-sections, said outer screen comprising a barrel that is perforated except in a stop area extending over a major part of its perimeter facing the passage area of said inner screen.

2. Heater according to claim 1, wherein said inner screen has an axially delimited passage area in a median part.

3. Heater according to claim 1, wherein said stop area comprises an axial extension facing non-perforated areas of said inner screen on the side facing the adjacent wall of the enclosure.

4. Heater according to claim 1, wherein said passage areas are formed on said outer screen by means of a mask adapted to cover partially a barrel that is perforated all over.

5. Steam generator feed water heater comprising a pressurized enclosure, a heat exchanger through which the feed water is caused to flow, at least one horizontal condensate inlet tube, at least one condensate outlet tube at a low point on said enclosure, and a double screen device associated with said at least one condensate inlet tube and comprising an inner screen with a cylindrical sidewall and, surrounding said inner screen, an outer screen having one end linked to said inner screen, a bottom wall common to both screens constituting an impact wall facing said inner screen, and passage areas in which there are provided perforations in said screen not facing each other over most of the perimeter of their transverse cross-sections, said outer screen having a downward passage area confined between two radial planes subtending between them an angle of less that 180°.

6. Steam generator feed water heater comprising a pressurized enclosure, a heat exchanger through which the feed water is caused to flow, at least one horizontal condensate inlet tube, at least one condensate outlet tube at a low point on said enclosure, and a double screen device associated with said at least one condensate inlet tube and comprising an inner screen with a cylindrical sidewall and, surrounding said inner screen, an outer screen having one end linked to said inner screen. A bottom wall common to both screens constituting an impact wall facing said inner screen and passage areas in which there are provided perforations in said screens not facing each other over most of the perimeter of their transverse cross-sections, juxtaposed one on each side of a diametral vertical plane of said enclosure two condensate inlet tubes each being equipped with a double screen inlet device, and downward passage areas having their mean directions directed towards a line defined on the wall of said enclosure by said vertical plane.

7. Steam generator feed water heater comprising a pressurized enclosure, a heat exchanger through which the feed water is caused to flow, at least one horizontal condensate inlet tube, at least one condensate outlet tube at a low point on said enclosure, and a double screen device associated with said at least one condensate inlet tube and comprising an inner screen with a cylindrical sidewall and, surrounding said inner screen an outer screen having one end linked to said inner screen, a bottom wall common to both screens constituting an impact wall facing said inner screen, and passage areas in which there are provided perforations in said screens not facing each other over most of the perimeter of their transverse cross-sections, a secondary condensate inlet tube facing a part of said heater which is normally submerged and a double screen device associated with said tube comprising an entirely perforated inner screen and an outer screen perforated only in its upper half.

* * * * *